US010106284B2

(12) United States Patent
Bacallao et al.

(10) Patent No.: US 10,106,284 B2
(45) Date of Patent: Oct. 23, 2018

(54) BAG RETAINING FIXTURE

(71) Applicant: Wal-Mart Stores, Inc., Bentonville, AR (US)

(72) Inventors: Yurgis Mauro Bacallao, Centerton, AR (US); John Levy, Fayetteville, AR (US); Levi Robinson, Centerton, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/695,306

(22) Filed: Sep. 5, 2017

(65) Prior Publication Data

US 2018/0065770 A1 Mar. 8, 2018

Related U.S. Application Data

(60) Provisional application No. 62/385,108, filed on Sep. 8, 2016, provisional application No. 62/385,097, filed on Sep. 8, 2016.

(51) Int. Cl.
*B65B 67/12* (2006.01)
*A47F 9/04* (2006.01)
(Continued)

(52) U.S. Cl.
CPC ..... *B65B 67/1266* (2013.01); *A47F 5/01* (2013.01); *A47F 7/00* (2013.01); *A47F 9/042* (2013.01);
(Continued)

(58) Field of Classification Search
CPC ..... B65B 67/1266; B65B 67/1211; B65B 67/1233; A47F 9/042; A47F 2067/1294; A47F 9/00; A47F 9/04
(Continued)

(56) References Cited

U.S. PATENT DOCUMENTS 473,099 A 4/1892 Vincentz
721,996 A 12/1902 Bunnell
(Continued)

FOREIGN PATENT DOCUMENTS

JP 6096712 B2 3/2017
WO 2006130911 A1 12/2006

OTHER PUBLICATIONS

Non-Final Office Action in U.S. Appl. No. 15/415,026, dated Dec. 28, 2017; 8 pages.
(Continued)

*Primary Examiner* — Muhammad Ijaz
(74) *Attorney, Agent, or Firm* — Schmeiser, Olsen & Watts LLP

(57) ABSTRACT

Described is a bagging station that uses a bag retaining fixture. The bag retaining fixture holds paper bags open at the bagging station so the paper bags can be filled without the bag moving or falling off the bagging station. The bag retaining fixture includes a plate and an elongate rod. The plate is coupled to the bagging station. The elongate rod is coupled to the plate such that the elongate rod captures a side of a paper bag between the elongate rod and a side wall of the bagging station. The bagging station can have a number of bag retaining fixtures coupled to it, so that a number of paper bags can be held open at a time, and filled with purchased items.

17 Claims, 8 Drawing Sheets

(51) Int. Cl.
*A47F 5/01* (2006.01)
*A47F 7/00* (2006.01)

(52) U.S. Cl.
CPC ..... *B65B 67/1211* (2013.01); *B65B 67/1227* (2013.01); *B65B 67/1233* (2013.01); *B65B 2067/1294* (2013.01)

(58) Field of Classification Search
USPC ..... 248/95, 97, 98, 99, 100, 101, 107, 112, 248/153, 175, 218.1, 249, 302; 211/163, 211/85.15
See application file for complete search history.

(56) References Cited

U.S. PATENT DOCUMENTS 743,547 A 7/1903 Nix
1,754,327 A 4/1930 Leonard
2,324,596 A 7/1943 Quain
3,055,508 A 9/1962 Reeser
3,175,793 A 3/1965 Kennedy
3,628,632 A 12/1971 Lambert
3,747,298 A * 7/1973 Lieberman ..... B65B 67/1266 248/100
3,838,839 A 10/1974 Spencer
3,847,332 A 11/1974 Murai
4,106,733 A 8/1978 Walitalo
4,106,734 A 8/1978 Walitalo
4,143,845 A * 3/1979 Harris ..... A47F 5/0815 248/220.43
4,398,689 A 8/1983 Prader
4,498,652 A 2/1985 Malik
RE33,122 E 12/1989 Orem
5,012,994 A 5/1991 Keefe
5,054,728 A * 10/1991 Nigro, Jr. ..... A47F 5/0823 248/220.41
5,131,499 A 7/1992 Hoar
5,462,178 A 10/1995 Wallach et al.
5,467,572 A 11/1995 Wile et al.
5,885,002 A 3/1999 Reiss
6,474,478 B1 11/2002 Huehner et al.
6,491,218 B2 * 12/2002 Nguyen ..... A47F 9/045 211/115
6,550,583 B1 * 4/2003 Brenhouse ..... A47F 9/042 186/61
7,114,650 B2 * 10/2006 Sherrod ..... G07F 11/24 235/381
7,516,820 B1 * 4/2009 Cox ..... A47F 9/046 186/66
7,753,588 B2 7/2010 Bazbaz
7,866,546 B1 1/2011 Vance
8,400,324 B1 3/2013 Jaeger
8,678,281 B2 3/2014 Kangas et al.
9,101,232 B1 8/2015 Newman
9,622,598 B1 4/2017 Davis, Jr.
9,622,599 B2 4/2017 Davis, Jr.
9,750,356 B2 9/2017 Tan
9,770,123 B2 * 9/2017 Tan ..... A47F 13/085
2002/0000504 A1 * 1/2002 Bayne ..... F21V 21/088 248/302
2004/0112850 A1 6/2004 Jordan
2005/0114216 A1 * 5/2005 Lantz ..... A47F 9/045 705/16
2005/0258177 A1 11/2005 Woodson
2007/0181753 A1 8/2007 Herlands
2009/0289019 A1 11/2009 Alvarado et al.
2010/0012793 A1 * 1/2010 Sung ..... B65F 1/1415 248/99
2010/0021088 A1 1/2010 Wilfong, Jr.
2010/0096514 A1 4/2010 Adair et al.
2010/0148019 A1 6/2010 Simhaee
2010/0314507 A1 * 12/2010 Laitila ..... B65B 67/1227 248/97
2011/0266092 A1 11/2011 Marquis et al.
2013/0223766 A1 8/2013 Gebhardt
2013/0259405 A1 10/2013 Jack
2014/0138499 A1 5/2014 Laitila et al.
2015/0048039 A1 2/2015 Laitila et al.
2017/0020307 A1 1/2017 Davis, Jr.
2017/0217621 A1 * 8/2017 Robinson ..... B65B 67/1233
2017/0280900 A1 10/2017 Bacallao
2017/0325603 A1 * 11/2017 Bacallao ..... A47F 9/042
2017/0354274 A1 * 12/2017 Bacallao ..... A47F 9/042
2018/0049565 A1 * 2/2018 Bacallao ..... A47F 9/04
2018/0064266 A1 * 3/2018 Bacallao ..... A47F 5/01
2018/0065770 A1 * 3/2018 Bacallao ..... A47F 5/01

OTHER PUBLICATIONS

Non-Final Office Action in U.S. Appl. No. 15/695,401, dated Feb. 2, 2018; 7 pages.
Weimaamerica, "Carousel Bagging System for WEIMA Briquette Press," YouTube.com, Apr. 15, 2009.
Web page image 1, accessed Dec. 29, 2015, https://www.google.co.in/imgres?imgurl=https://c1.staticflickr.com/3/2932/14248018844_89e3d89fa4_b.jpg&imgrefurl=https://www.flickr.com/photos/jeepersmedia/14248018844&h=950&w=1024&tbnid=MyLI_TOn6HIMCM:&docid=9feoV3Exk3O-4M&ei=jfyAVsbyJMPluASeoa6QBw&tbm=isch&ved=0ahUKEwiG7Z7tmv7JAhVDJI4KHZ6QC3lQMwgkKAkwCQ.
Web page image 2, accessed Dec. 29, 2015, https://www.flickr.com/photos/fourstarcashiernathan/6979145827.
"Over Door Bag Holder Waste Bin, Hang Over Kitchen Door, Reuses Shopping Bags," Klife, Ebay.com, accessed on May 23, 2016; 4 pages.
"100mm metal wire clip/clipboard clip," Dongguan Taoyuan Stationary Co., Ltd., Sell.Lulusoso.com, accessed May 20, 2016; 4 pages.
Notice of Allowance for U.S. Appl. No. 15/695,401, dated May 4, 2018.
Notice of Allowance in U.S. Appl. No. 15/415,026 dated May 21, 2018; 6 pages.

* cited by examiner

BAG RETAINING FIXTURE

CROSS REFERENCE TO RELATED APPLICATION

This invention claims priority to U.S. provisional patent application Ser. No. 62/385,097, filed Sep. 8, 2016 to Applicant Wal-Mart Stores Inc., and entitled "Paper Bag Retaining Fixture", and to U.S. provisional patent application Ser. No. 62/385,108, filed Sep. 8, 2016 to Applicant Wal-Mart Stores Inc., and entitled "Bag Retaining Fixture", both of which are incorporated entirely herein by reference.

BACKGROUND OF THE INVENTION

Technical Field

This invention relates to fixtures for retail stores, and more specifically to a clip for holding a paper-type bag open while the bag is being filled at a bagging station.

State of the Art

A bagging station is a fixture in a retail store where purchased items are loaded into bags so the items can be carried out of the store by the customer. Bagging stations are often located at checkout registers where purchased items are paid for. Bagging stations are usually designed to store and dispense plastic bags. Bagging stations will have hooks to hang plastic bags from as they are stored and dispensed. When paper-type bags are being dispensed at a bagging station instead of plastic bags, it is often difficult to keep the open bag in one place while it is being filled. The open bag can sit on the bagging station top surface, but it often slides and moves around unless something is used to hold it in place.

Accordingly, what is needed is a bag retaining fixture that can temporarily hold an open paper-type bag in place at a bagging station, keeping the open bag from moving around while it is being filled at the bagging station.

DETAILED DESCRIPTION OF EMBODIMENTS OF THE INVENTION

The disclosed invention relates to fixtures for a retail store, and more specifically to a clip for holding a paper-type bag open while the bag is being filled at a bagging station A bagging station is a location in a retail store where purchased items are loaded into bags so the items can be carried out of the store by the customer. Bagging stations are often at checkout registers where purchased items are paid for. Bagging stations are usually designed to store and dispense plastic bags. The bagging station will have hooks and arms for holding stacks of plastic bags, and for hanging plastic bag arms from, to keep the plastic bag open while filling. In some locations and jurisdictions, however, paper-type bags are used instead of plastic bags. A paper-type bag is a bag made of semi-rigid material. Paper-type bags includes traditional brown paper bags, as well as bags made of semi-rigid plastic or composite materials. The term "paper bag" is used throughout this document, but it is to be understood that bags formed of other semi-rigid material such as plastic or composite materials can be substituted for the paper bags described in this document. Some customers and locations prefer paper bags over plastic. Some jurisdictions have ruled that paper bags should be used instead of plastic bags. Environmental laws or restrictions can often dictate that paper bags be used in retail stores instead of plastic bags.

In order to make bagging stations work well with paper bags, it is desirable to have a bag retaining fixture that will hold a paper bag open on the bagging station while the bag is being filled. Described herein is a bagging station that uses a bag retaining fixture. The bag retaining fixture holds paper bags open at the bagging station so the paper bags can be filled without the bag moving or falling off the bagging station. The bag retaining fixture includes a plate and an elongate rod. The plate is coupled to the bagging station. The elongate rod is coupled to the plate such that the elongate rod captures a side of a paper bag between the elongate rod and a side wall of the bagging station. The bagging station can have a number of bag retaining fixtures coupled to it, so that a number of bags can be held open at a time, and filled with purchased items. The bag retaining fixtures keep paper bags in place at the bagging station, allow bagging station carousels to rotate without throwing off the open paper bags, and keeps bagging stations neat and useful with paper bags as well as plastic bags.

Figure 1:
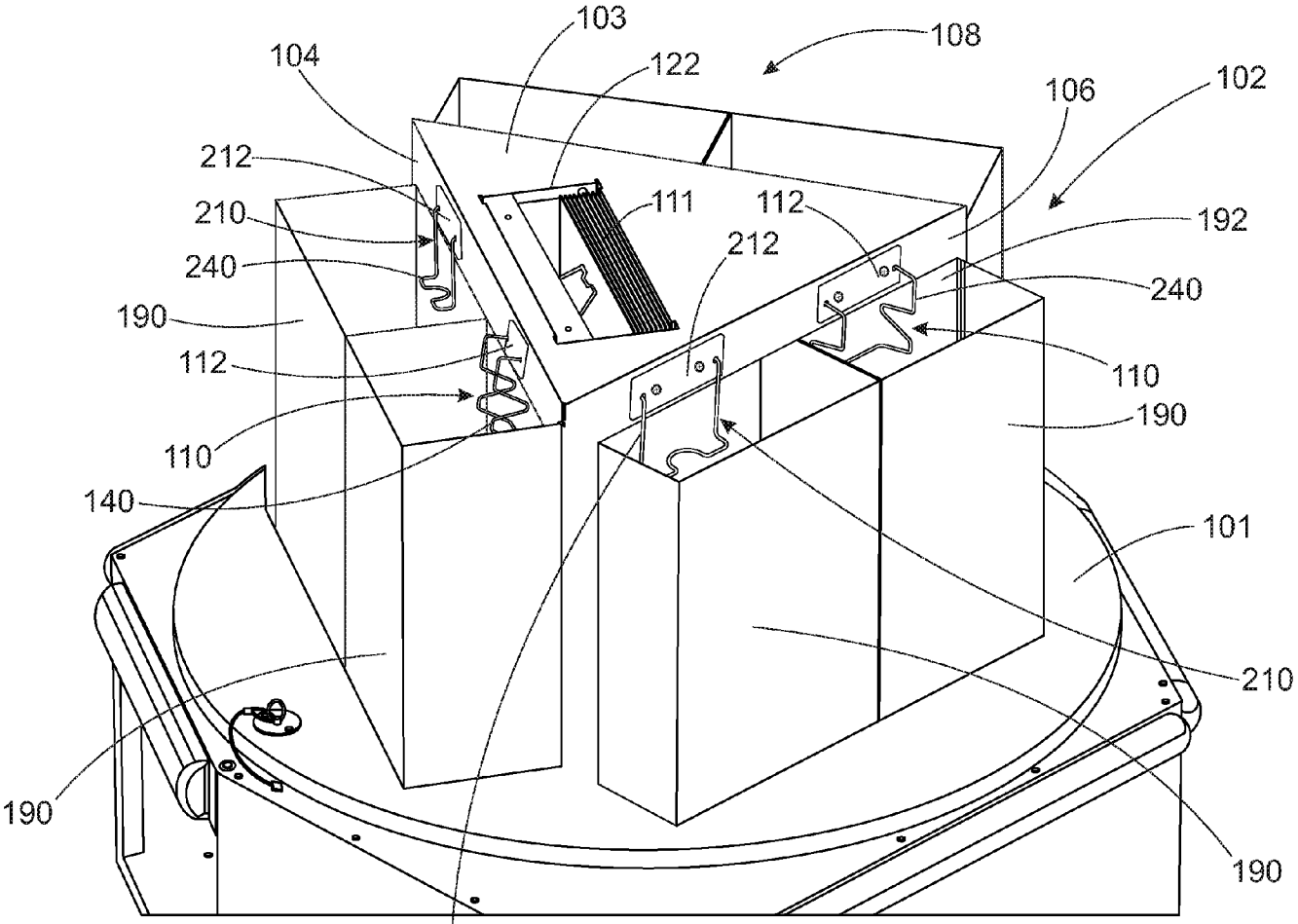
FIG. 1 shows a bagging station with bag retaining fixtures.
Figure 2:
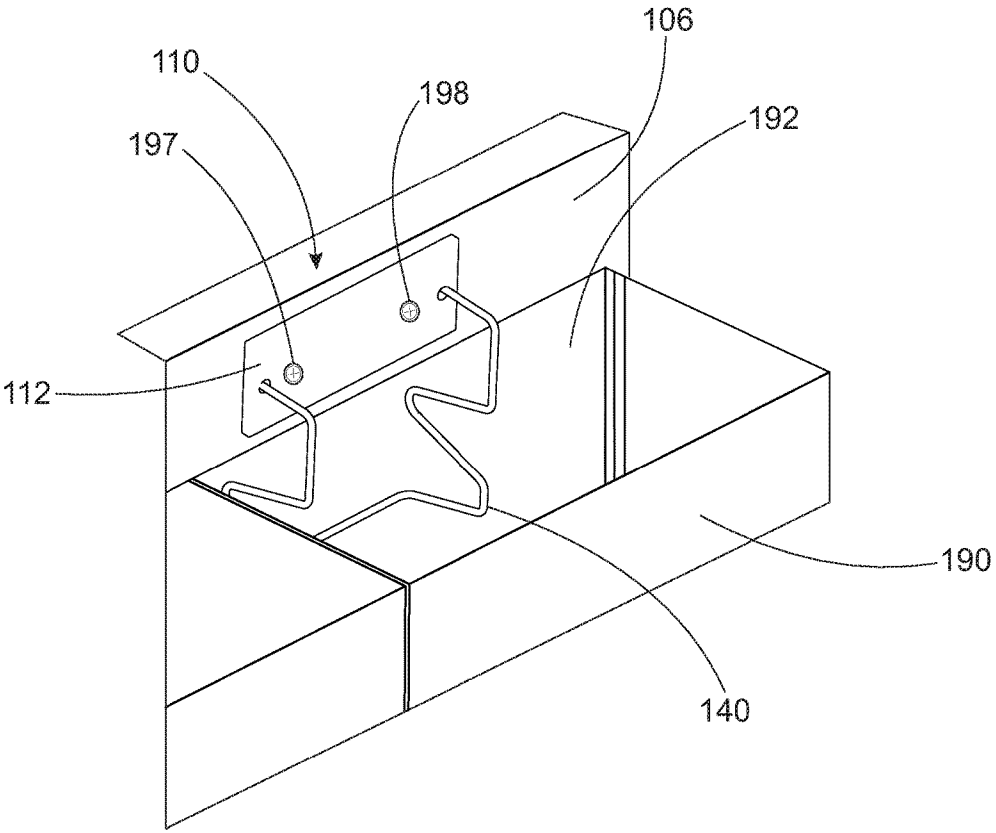
FIG. 2 shows a close up of a bag retaining fixture holding open a paper-type bag.
Figure 3:
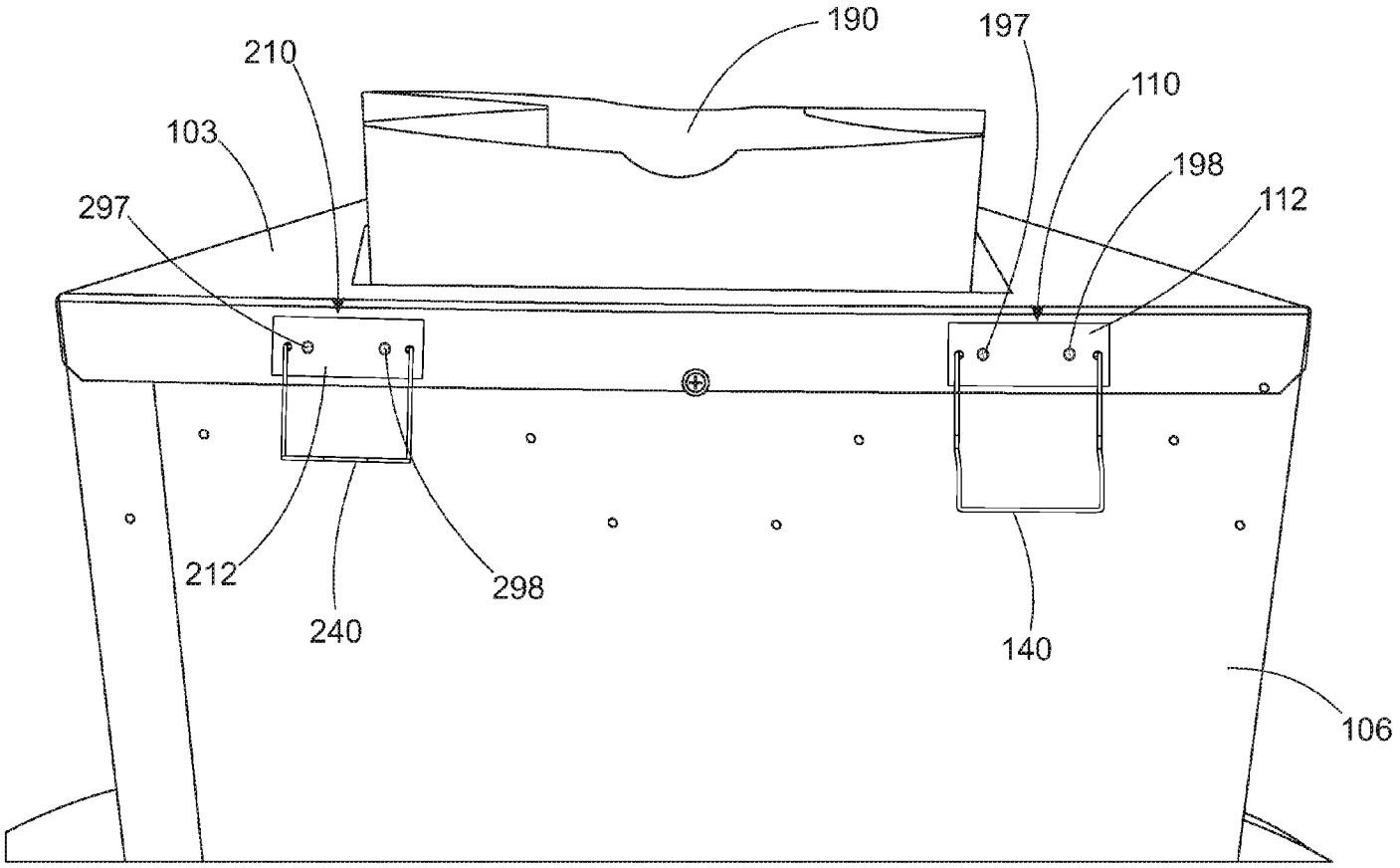
FIG. 3 shows a side of the bagging station with two bag retaining fixtures.

FIG. 1 shows a bagging station 108 with a plurality of bag retaining fixtures 110 and 210 for holding paper bags 190 open. FIG. 2 shows an enlarged view of bag retaining fixture 110 holding open a paper bag 190 at bagging station 108 of FIG. 1. FIG. 3 shows a close up view of a side 106 of bagging station 108 with one bag retaining fixture 110 and one bag retaining fixture 210 coupled to side 106. Bag retaining fixtures 110 and 210 each hold paper bags 190 open at bagging station 108 so that paper bags 190 can be filled with purchased items.

Bagging station 108 is a carousel-type bagging station that is often used at a checkout register of a retail store for bagging items that have been purchased in the retail store. Bagging station 108 includes a carousel 102 that includes a rotating platform 101 and a center section 103. Center section 103 has a cabinet 122 for holding a stack of paper bags 111. Center section 103 has a number of bag retaining fixtures 110 and 210 on its sides 104 and 106 as shown in FIG. 1. Bag retaining fixtures 110 and 210 hold open paper bags 190 as shown. Each bag retaining fixture 110 and 210 holds a side 192 of paper bag 190 between an elongate rod 140 or 240 and the side 104 or 106 of center section 103. Rotating platform 101 rotates to allow the bagger to place items in paper bags 190 as they are purchased. Paper bags 190 that are full can be removed from bagging station 108 and carried out of the retail store. Once a paper bag 190 is removed, an empty paper bag 190 can be retrieved from stack of paper bags 111, opened, and put in place on carousel 102 for filling, held in place with a bag retaining fixture 110 or 210.

Figure 4:
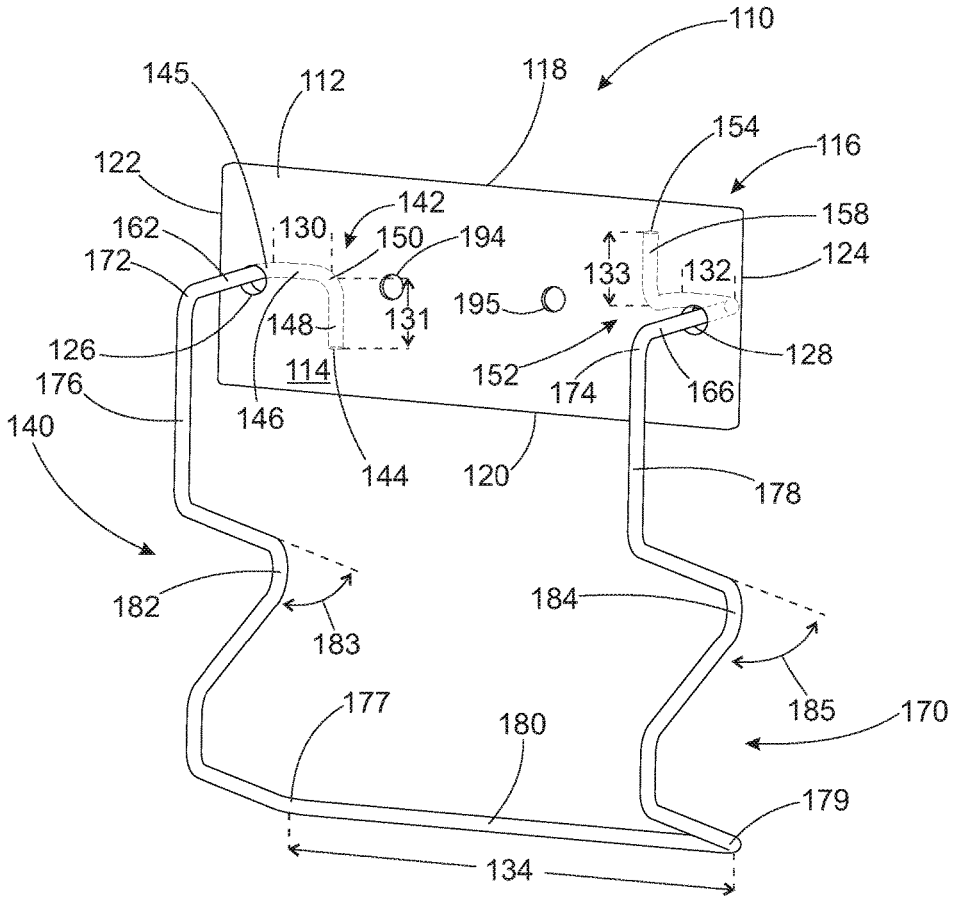
FIG. 4 shows an embodiment of a bag retaining fixture.
Figure 5:
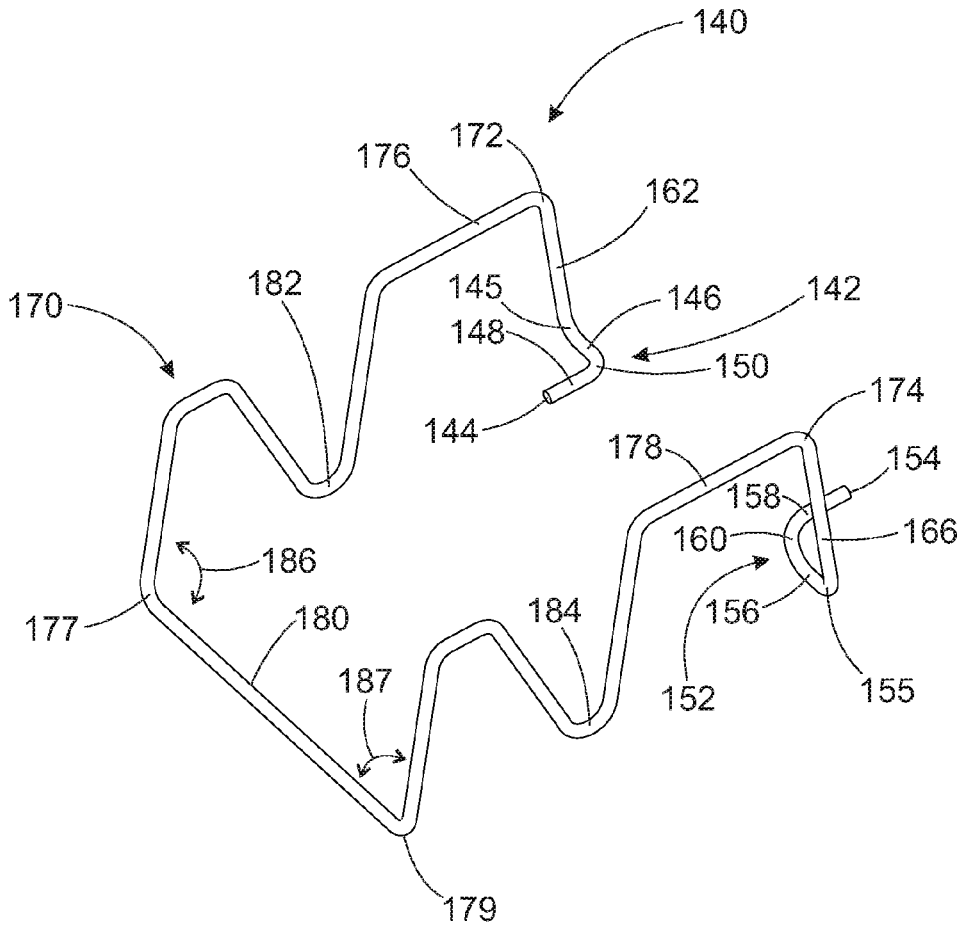
FIG. 5 shows a perspective view of an elongate rod of the bag retaining fixture of FIG. 4.

FIG. 4 and FIG. 5 show details of an embodiment of a bag retaining fixture 110. FIG. 1, FIG. 2, and FIG. 3 show bag retaining fixture 110 coupled to bagging station 108. FIG. 4 shows a perspective view of bag retaining fixture 110. FIG. 5 shows a perspective view of an elongate rod 140 of bag retaining fixture 110. Bag retaining fixture 110 includes a plate 112 and elongate rod 140. Plate 112 couples to a side 104 or 106 of bagging station 108, as shown in FIG. 1 through FIG. 3. Coupling plate 112 to a side 104 or 106 of bagging station 108 couples elongate rod 140 to plate 112 and allows elongate rod 140 to capture side 192 of paper bag 190 between elongate rod 140 of bag retaining fixture 110 and side 104 or 106 of bagging station 110, as can best be seen in FIG. 2. In the embodiment shown in FIG. 1 through FIG. 3, bag retaining fixture 110 is coupled to side 106 of bagging station 108 using screws 197 and 198 (FIG. 2 and FIG. 3) through screw holes 194 and 195 (FIG. 4). Once bag retaining fixture 110 is coupled to side 106 of bagging station 108, elongate rod 140 is biased to put pressure on side 106. When side of paper bag 192 is slid between elongate rod 140 and side 106, paper bag 190 is held open and in place on bagging station 108. Each bag retaining fixture 110 holds a paper bag 190 open and in place on bagging station 108, helping to keep paper bags 190 from falling off and being scattered from bagging station 108.

Plate 112 includes a front surface 114, a rear surface 116 opposing front surface 114, a top edge 118, a bottom edge 120 opposing top edge 118, a first side edge 122, and a second side edge 124 opposing first side edge 122. Plate 112 in this embodiment is a flat rectangular metal plate, but this is not meant to be limiting. Plate 112 can be a flat plate of any number of rigid material, and can be in shapes other than rectangular. Plate 112 is configured to be coupled to a side 104 or 106 of bagging station 108. In this embodiment, plate 112 is configured to be coupled to bagging station 108 using screw holes 194 and 195, as shown in FIG. 4. Screws 197 and 198 (FIG. 2 and FIG. 3) extend through screw holes 194 and 195 to couple plate 112 to bagging station 108. It is to be understood, however, that plate 112 can be coupled to bagging station 108 in many different ways and using many different types of couplers, as is known in the art.

Elongate rod 140 is formed of a rigid or semi-rigid wire, rod, or bar, best seen in FIG. 5. Elongate rod 140 is semi-rigid in this embodiment so that a number of bends can be put in elongate rod 140 to facilitate elongate rod 140 putting pressure on bagging station 108 and pressing, or capturing, side 192 of paper bag 190 between elongate rod 140 and side 104 or 106 of bagging station 108. Elongate rod 140 can be bent into many different shapes to capture side 192 of paper bag 190 between side 106 and elongate rod 140. In the embodiment of bag retaining fixture 110 shown in the figures, elongate rod 140 includes an elongate rod first end 144 and an elongate rod second end 154 opposing elongate rod first end 144. Elongate rod is divided into a number of different sections or portions by bends in elongate rod 140. Elongate rod 140 is divided into a first end portion 142, a first pass through portion162, a bag retaining section 170, a second pass through portion 166, and a second end portion 152.

First and second end portions 142 and 152 are portions of elongate wire 140 that are captured between plate 112 and bagging station 108 when plate 112 is coupled to bagging station 108.

First end portion 142 extends from elongate rod first end 144 to a first pass through portion first end 145, see FIG. 5. First end portion 142 is adjacent to rear surface 116 along a length L1 that is equal to a length 130 plus a length 131 as shown in FIG. 4. First end portion 142 is captured, or secured, between rear surface 116 and side 106 of bagging station 108 when plate 112 is coupled to side 106, as shown in FIG. 2. First end portion 142 includes a first longitudinal section 146 and a first crosswise section 148 (FIG. 4 and FIG. 5). First crosswise section 148 extends from elongate rod first end 144 to a first end portion bend 150 in first end portion 142. First end portion bend 150 is a bend of approximately 90 degrees in elongate rod 140 in this embodiment, but this is not meant to be limiting. First crosswise section 148 extends along rear surface 116 in a direction approximately perpendicular to top edge 118, and has length 131.

First longitudinal section 146 extends from first end portion bend 150 to first pass through portion first end 145. First longitudinal section 146 extends along rear surface 116 in a direction approximately parallel to top edge 118, and has a length 130 as shown in FIG. 4. First end portion 142 has a length L1 equal to length 130 plus length 131. First end portion 142 is adjacent to rear surface 116 of plate 112 along length L1 because first end portion 142 is pressed between rear surface 116 and bagging station 108. Plate 112 presses end portion 142 against side wall 104 or 106, for example, of bagging station 108 to hold first end portion 142 in place, which helps keep bag retaining section 170 holding paper bag 190 open.

First longitudinal section 146 extends in a direction approximately parallel to top edge 118 so that first longitudinal section 146 will securely hold first end portion 142 and keep elongate rod 140 from moving side-to side. First crosswise section 148 extends in a direction approximately perpendicular to top edge 118. In this embodiment, first crosswise section 148 extends from first end portion bend 150 towards bottom edge 120 of plate 112. Having first crosswise section 148 extend perpendicular to top edge 118 keeps elongate rod 140 pressed against bagging station 108 and side 192 of paper bag 190.

Second end portion 152 includes a second longitudinal section 156 and a second crosswise section 158, see FIG. 5. Second end portion 152 extends from a second pass through portion first end 155 to elongate rod second end 154, see FIG. 4 and FIG. 5. Second longitudinal section 156 extends in a direction approximately parallel to top edge 118 and has a length 132 as shown in FIG. 4. Second crosswise section 158 extends in a direction approximately perpendicular to top edge 118 and has a length 133. Second end portion 152 has a length L2 equal to length 132 plus length 133. Second end portion 152 is adjacent to rear surface 116 of plate 112 along length L2 because second end portion 152 is pressed between rear surface 116 and bagging station 108. Plate 112 presses second end portion 152 against side wall 104 or 106, for example, of bagging station 108 to hold second end portion 152 in place and keep bag retaining section 170 holding paper bag 190 open, a shown in FIG. 2 and FIG. 4.

Second longitudinal section 156 extends from second pass through portion first end 155 to a second end portion bend 160 (FIG. 5). Second longitudinal section 156 extends along rear surface 116 in a direction approximately parallel to top edge 118 so that second longitudinal section 156 will securely hold second end portion 152 and keep elongate rod 140 from moving side-to side.

Second crosswise section 158 extends from second end portion bend 160 to elongate rod second end 154 of elongate rod 140. Second crosswise section 158 extends along rear surface 116 in a direction approximately perpendicular to top edge 118. In this embodiment, second crosswise section 158 extends from second end portion bend 160 towards top edge 118 of plate 112. Having second crosswise section 158 extend perpendicular to top edge 118 keeps elongate rod 140 pressed against bagging station 108. Having first crosswise section 148 and second crosswise section 158 extend in opposite directions adds to the stability of elongate rod 140, but this is not meant to be limiting. In some embodiments, first crosswise section 148 and second crosswise section 158 extend in the same direction.

First and second pass through portions 162 and 166 are the portions of elongate rod 140 that pass through holes in plate 112 so that elongate rod 140 can pass through plate 112. First pass through portion 162 extends through a first hole 126 (FIG. 4) in plate 112. First pass through portion 162 extends from first pass through portion first end 145 to a bag retaining section first end 172, as shown in FIG. 4 and FIG. 5. Second pass through portion 166 extends through a second hole 128 in plate 112. Second pass through portion 166 extends from a bag retaining section second end 174 to second pass through portion first end 155, as shown in FIG. 4 and FIG. 5.

Bag retaining section 170 is the portion of elongate rod 140 that captures (presses) side 192 of paper bag 190 between elongate rod 140 and a side 104 or 106 of bagging station 108. Bag retaining section 170 is the portion of elongate rod 140 that extends from bag retaining section first end 172 to bag retaining section second end 174 as shown in FIG. 4 and FIG. 5. Bag retaining section second end 174 opposes bag retaining section first end 170. Bag retaining section 170 extends from front surface 114 of plate 112, specifically from holes 126 and 128 of plate 112. In this embodiment, bag retaining section 170 extends in a direction towards bottom edge 120. Bag retaining section 170 captures side 192 of paper bag 190 between bag retaining section 170 and side wall 104 or 106 of bagging station 108 in response to plate 112 being coupled to side wall 104 or 106 of bagging station 108. Bag retaining section first end 172 is coupled first pass through portion 162. Bag retaining section second end 174 is coupled second pass through portion 166, as shown in FIG. 4 and FIG. 5.

Bag retaining section 170 includes a first arm 176 a second arm 178, and a pressure section 180, as shown in FIG. 4 and FIG. 5. First arm 176 extends from bag retaining section first end 172 that is coupled to first pass through portion162, to a first arm second end 177 that is coupled to pressure section 180. Second arm 178 extends from bag retaining sections second end 174 that is coupled to second pass through portion 166, to a second arm second end 179 coupled to pressure section 180.

Pressure section 180 couples first arm 176 to second arm 178. Pressure section 180 extends from first arm second end 177 to second arm second end 179. Pressure section 180 is the part of bag retaining section 170 that captures side 192 of paper bag 190 between bag retaining section 170 and side wall 104 or 106. In the embodiment shown, pressure section 180 includes a straight length 134 (FIG. 4) of elongate rod 140 between first arm second end 177 and second arm second end 179, that presses the side 192 of paper bag 190 between straight length 134 of elongate rod 140 and side wall 104 or 106 of bagging station 108. Pressure section 180 is approximately perpendicular to bot first arm 176 and second arm 178. A first bag retaining bend angle 186 is between first arm 176 and pressure section 180. First bag retaining bend angle 186 is approximately 90 degrees in this embodiment, but this is not meant to be limiting. A second bag retaining bend angle 187 is between second arm 178 and pressure section 180. Second bag retaining bend angle 187 is approximately 90 degrees in this embodiment, but this is not meant to be limiting.

In the embodiment of bag retaining fixture 110 shown in the figures, bag retaining section 170 has several portions that put pressure on side 192 of paper bag 190. In this embodiment, first arm 176 includes a first pressure elbow bend 182. First pressure elbow bend 182 is created by bending elongate rod 140 through a bend angle 183 in first arm 176, where bend angle 183 is greater than 90 degrees. First pressure elbow bend 182 presses against side 192 of paper bag 190 to capture side 192 of paper bag 190 between bag retaining section 170 and side 104 or 106 of bagging station 108. Second arm 178 includes a second pressure elbow bend 184. Second pressure elbow bend 184 is created by bending elongate rod 140 through a bend angle 185 in second arm 178, where bend angle 185 is greater than 90 degrees. Second pressure elbow bend 184 presses against side 192 of paper bag 190 to capture side 192 of paper bag 190 between bag retaining section 170 and side 104 or 106 of bagging station 108.

It is to be understood that elongate rod 140 can include other bends and portions that are used to capture side 192 of paper bag 190 between elongate rod 140 and a side of bagging station 108.

Figure 6:
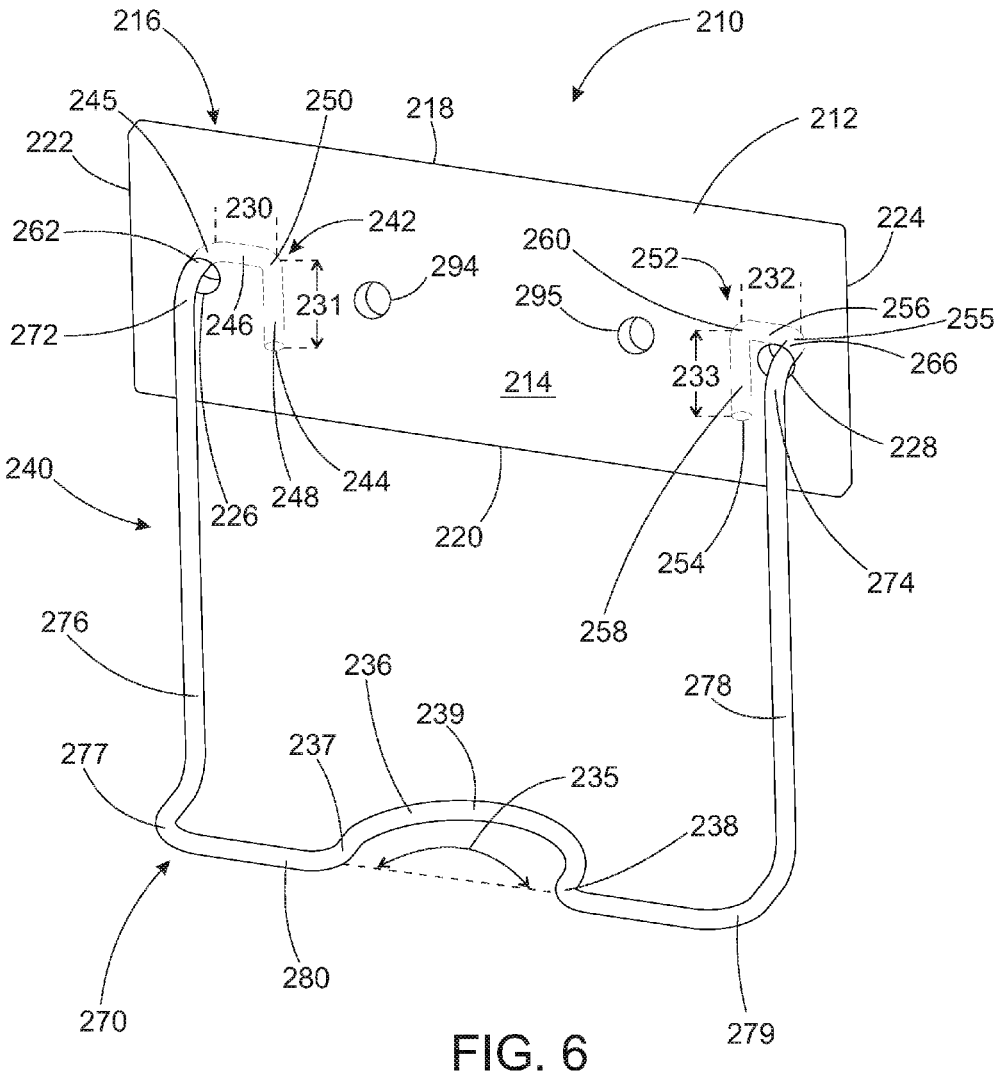
FIG. 6 shows a further embodiment of a bag retaining fixture.
Figure 7:
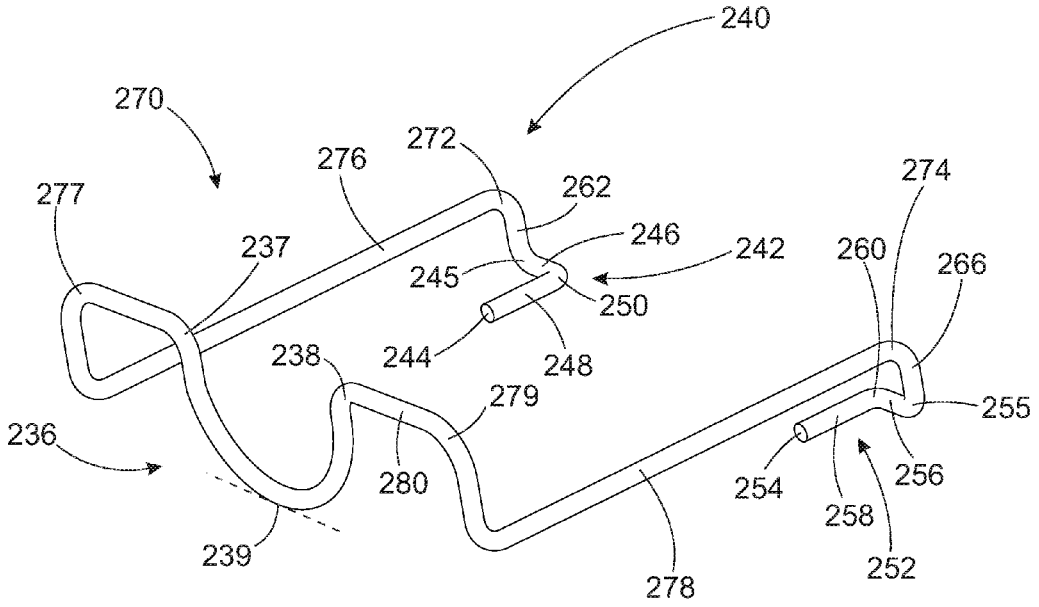
FIG. 7 shows an elongate rod of the bag retaining fixture of FIG. 6.

FIG. 6 and FIG. 7 show details of an embodiment of a bag retaining fixture 210. FIG. 1 and FIG. 3 show bag retaining fixture 210 coupled to bagging station 108. FIG. 6 shows a perspective view of bag retaining fixture 210. FIG. 7 shows a perspective view of an elongate rod 240 of bag retaining fixture 210. Bag retaining fixture 210 is similar to bag retaining fixture 110, but has a different shape to its elongate rod. Bag retaining fixture 210 can be used in place of bag retaining fixture 110. Bag retaining fixture 210 includes a plate 212 and an elongate rod 240. Plate 212 couples to a side of bagging station 108, such as side 104 or 106 for example, but not by way of limitation, as shown in FIG. 1 and FIG. 3. Coupling plate 212 to a side 104 or 106 of bagging station 108 couples elongate rod 240 to plate 212 and causes elongate rod 240 to capture (press) a side 192 of paper bag 190 between elongate rod 240 of bag retaining device 210 and side 104 or 106 of bagging station 108, as can best be seen in FIG. 1. Bag retaining fixture 210 is coupled to side 104 or 106 of bagging station 108 using screws 297 and 298 (FIG. 3) through screw holes 294 and 295 (FIG. 6). Once bag retaining fixture 210 is coupled to side 104 or 106 of bagging station 108, elongate rod 240 is biased to put pressure on side 104 or 106. When side 192 of paper bag 190 is slid between elongate rod 240 and side 104 or 106, paper bag 190 is held open and in place on bagging station 108. Each paper bag retaining fixture 210 holds a paper bag 190 open and in place on bagging station 108, helping to keep paper bags 190 from falling off and being scattered from bagging station 108.

Plate 212 includes a front surface 214, a rear surface 216 opposing front surface 214, a top edge 218, a bottom edge 220, a first side edge 222, and a second side edge 224 opposing first side edge 222. Plate 212 is configured to be coupled to a side, such as side 104 or 106, of bagging station 108. In this embodiment, plate 212 is configured to be coupled to bagging station 108 using screw holes 294 and 295, as shown in FIG. 6. Screws 297 and 298 (FIG. 3) extend through screw holes 294 and 295 to couple plate 212 to bagging station 108. It is to be understood, however, that plate 212 can be coupled to bagging station 108 in many different ways and using many different types of couplers as is known in the art.

Elongate rod 240 is formed of a semi-rigid wire, rod, or bar. Elongate rod 240 is semi-rigid so that a number of bends can be put in elongate rod 240 to facilitate elongate rod 240 putting pressure on bagging station 108 and capturing side 192 of paper bag 190 between elongate rod 240 and side 104 or 106 of bagging station 108. Elongate rod 240 can be bent into many different shapes to capture side 192 of paper bag 190 between side 106 and elongate rod 240. In the embodiment of bag retaining fixture 210 shown in the figures, elongate rod 240 includes a first end portion 242, a first pass through portion 262, a bag retaining section 270, a second pass through portion 266, and a second end portion 252.

First and second end portion 242 and 252 are the portions of elongate wire 240 that are captured between plate 212 and bagging station 108. First end portion 242 extends from elongate rod first end 244 to a first pass through portion first end 245. First end portion 242 includes a first longitudinal section 246 and a first crosswise section 248. First longitudinal section 246 extends in a direction approximately parallel to top edge 218 and has a length 230 as shown in FIG. 6. First crosswise section 248 extends in a direction approximately perpendicular to top edge 218 and has a length 231. First end portion 242 has a length L3 equal to length 230 plus length 231. First end portion 242 is adjacent to rear surface 216 of plate 212 along length L3 because first end portion 242 is captured between rear surface 216 and bagging station 108. Plate 212 presses first end portion 242 against side wall 104 or 106, for example, of bagging station 108 to hold first end portion 242 in place and keep bag retaining section 270 holding paper bag 190 open.

First longitudinal section 246 extends from first pass through portion first end 245 to a first end portion bend 250. First longitudinal section 246 extends in a direction approximately parallel to top edge 218 so that first longitudinal section 246 will securely hold first end portion 242 and keep elongate rod 240 from moving side-to side.

First crosswise section 248 extends from first end portion bend 250 to elongate rod first end 244. First crosswise section 248 extends in a direction approximately perpendicular to top edge 218. In this embodiment first crosswise section 248 extends from first end portion bend 250 towards bottom edge 220 of plate 212. Having first crosswise section 248 extend perpendicular to top edge 218 keeps elongate rod 240 pressed against bagging station 108

Second end portion 252 extends from a second pass through portion first end 255 to elongate rod second end 254. Second end portion 252 includes a second longitudinal section 256 and a second crosswise section 258, see FIG. 6, and FIG. 7. Second longitudinal section 256 extends in a direction approximately parallel to top edge 218 and has a length 232 as shown in FIG. 6. Second crosswise section 258 extends in a direction approximately perpendicular to top edge 218 and has a length 233. Second end portion 252 has a length L4 equal to length 232 plus length 233. Second end portion 252 is adjacent to rear surface 216 of plate 212 along length L4 because second end portion 252 is captured between rear surface 216 and bagging station 108. Plate 212 presses second end portion 252 against side wall 104 or 106, for example, of bagging station 108 to hold second end portion 252 in place and keep bag retaining section 270 holding paper bag 190 open.

Second longitudinal section 256 extends from second pass through portion first end 255 to a second end portion bend 260. Second longitudinal section 256 extends in a direction approximately parallel to top edge 218 so that second longitudinal section 256 will securely hold second end portion 252 and keep elongate rod 240 from moving side-to side. Second crosswise section 258 extends from second end portion bend 260 to a second end 254 of elongate rod 240. Second crosswise section 258 extends in a direction approximately perpendicular to top edge 218. In this embodiment, second crosswise section 258 extends from second end portion bend 260 towards bottom edge 220 of plate 212. Having second crosswise section 258 extend perpendicular to top edge 218 keeps elongate rod 240 pressed against bagging station 108. In some embodiments, second crosswise section 258 extends from second end portion bend 260 towards top edge 218 of plate 212.

First and second pass through portions 262 and 266 are the portions of elongate rod 240 that pass through holes in plate 212 so that elongate rod 240 can pass through from back surface 216 to front surface 214 of plate 212. First pass through portion 262 extends through a first hole 226 in plate 212. First pass through portion 262 extends between first end portion first end 245 to a bag retaining section first end 272, as shown in FIG. 6 and FIG. 7. Second pass through portion 266 extends through a second hole 228 in plate 212. Second pass through portion 266 extends between second end portion first end 255 and a bag retaining section second end 274, as shown in FIG. 6 and FIG. 7.

Bag retaining section 270 is the portion of elongate rod 240 that captures side 192 of paper bag 190 between elongate rod 270 and a side 104 or 106 of bagging station 108. Bag retaining section 270 is generally in the shape of a rectangle with one side missing. Bag retaining section 270 extends from bag retaining section first end 272 and bag retaining section second end 274 opposing bag retaining section first end 272. Bag retaining section 270 extends from front surface 214 of plate 212. In this embodiment, bag retaining section 270 extends in a direction towards bottom edge 220. Bag retaining section 270 captures side 192 of paper bag 190 between bag retaining section 270 and side wall 104 or 106 of bagging station 108 in response to plate 212 being coupled to side wall 104 or 106 of bagging station 108.

Bag retaining section 270 includes a first arm 276, a second arm 278, and a pressure section 280, as shown in FIG. 6 and FIG. 7. First arm 276 extends from bag retaining section first end 272 coupled to first pass through portion 262, to a first arm second end 277 that is coupled to a pressure section 280. Second arm 278 extends from bag retaining section second end 274 coupled to second pass through portion 266, to a second arm second end 279 coupled to pressure section 280.

Pressure section 280 couples first arm 276 to second arm 278. Pressure section 280 extends from first arm second end 277 to second arm second end 279. Pressure section 280 is approximately perpendicular to both first arm 276 and second arm 278. Pressure section 280 is the part of bag retaining section 270 that captures the side 192 of paper bag 190 between bag retaining section 270 and side wall 104 or 106. In the embodiment shown, pressure section 280 includes a semi-circular section 236. Semi-circular section 236 is a part of pressure section 280 that is semi-circular shaped. Semi-circular section 236 is formed by putting a bend in pressure section 280 that is in the shape of an arc of a circle. In this embodiment, semi-circular section 236 is in the shape of an arc with an arc angle 235 of about 180 degrees, but this is not meant to be limiting. Semi-circular section 236 includes a first semi-circular end 237 coupled to first arm 276, a second semi-circular end 238 coupled to second arm 278 and a pressure point 239 between first semi-circular end 237 and second semi-circular end 238. Pressure point 239 is the location on the semi-circle that is furthest away from first and second end 237 and 238. Pressure point 239 is also the part of pressure section 280 that presses side 292 of paper bag 290 between side 104 or 106 of bagging station 108. An arc angle 235 of about 180 degrees adds stability to pressure section 280 while providing a pressure point for holding side 192 of paper bag 190. In some embodiments, arc angle 235 is an arc angle of other degrees.

Figure 8:
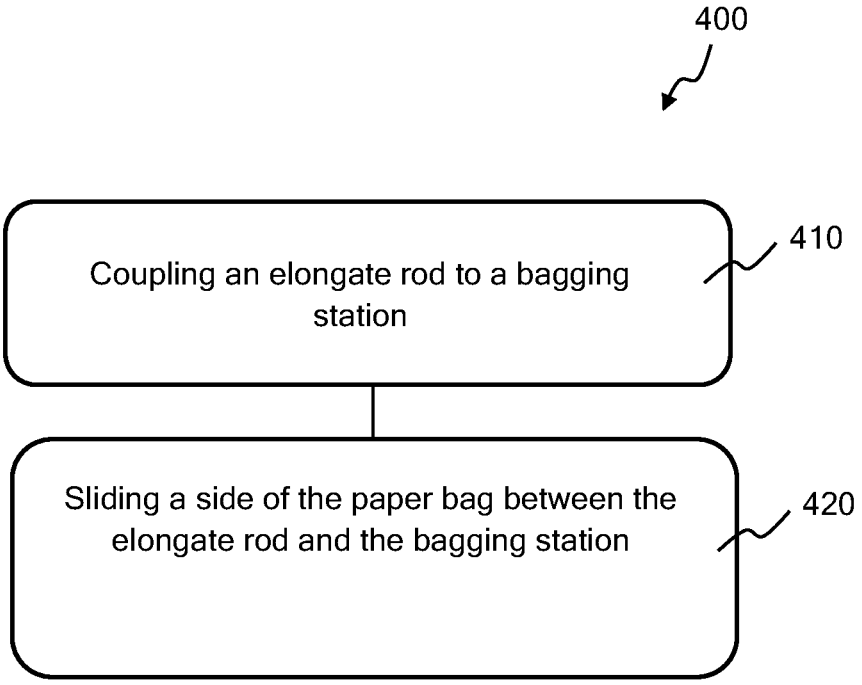
FIG. 8 illustrates a method of holding a paper bag open.

FIG. 8 illustrates a method 400 of holding a paper bag open. Method 400 includes an act 410 of coupling an elongate rod to a bagging station. Method 400 also includes an act 420 of sliding a side of the paper bag between the elongate rod and the bagging station. Method 400 can include many other acts.

In some embodiments, act 410 of coupling the elongate rod to the bagging station includes forming a flat plate. In some embodiments, act 410 of coupling the elongate rod to the bagging station includes putting a first hole through the flat plate. In some embodiments, act 410 of coupling the elongate rod to the bagging station includes putting a second hole through the flat plate. In some embodiments, act 410 of coupling the elongate rod to the bagging station includes extending a first end of the elongate rod through the first hole in the flat plate. In some embodiments, act 410 of coupling the elongate rod to the bagging station includes extending a second end of the elongate rod through the second hole in the flat plate. In some embodiments, act 410 of coupling the elongate rod to the bagging station includes coupling the flat plate to the bagging station.

In some embodiments, method 400 includes putting a pressure elbow bend in the elongate rod, wherein the pressure elbow bend has a bend angle of greater than 90 degrees. In some embodiments, method 400 includes forming a semi-circular section in the elongate rod, wherein the semi-circular section is a circular arc-shaped bend in the elongate rod, with an arc angle of approximately 180 degrees. In some embodiments, method 400 includes forming a straight length of rod in the elongate rod, wherein the straight length of rod captures the side of the paper bag between the straight length of rod and the bagging station. In some embodiments, method 400 includes forming a first end portion in the elongate rod, wherein the first end portion includes a first longitudinal section, where the first longitudinal section extends from the first pass through portion to a first end portion bend in a direction approximately parallel to the top edge of the plate. In some embodiments, method 400 includes forming a first cross-wise section, where the first cross-wise section extends from the first end portion bend to a first end, in a direction approximately perpendicular to the top edge of the plate. In some embodiments, method 400 includes forming a second end portion in the elongate rod, where the second end portion includes a second longitudinal section, where the second longitudinal section extends from the second pass through portion to a second end portion bend in a direction approximately parallel to the top edge of the plate. In some embodiments, method 400 includes forming a second cross-wise section, where the second cross-wise section extends from the second end portion bend to a second end, in a direction approximately perpendicular to the top edge of the plate The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A bag retaining fixture comprising:

a plate having a front surface, a rear surface, a top edge and a bottom edge, wherein the plate is configured to be coupled to a bagging station; and an elongate rod, wherein the elongate rod comprises:

an elongate rod first end;

an elongate rod second end;

a first end portion extending from the elongate rod first end to a first pass through portion first end, wherein the first end portion is adjacent to the rear surface along a first end portion length, and wherein the first end portion comprises:

a first cross-wise section, wherein the first cross-wise section extends along the rear surface in a direction perpendicular to the top edge, and wherein the first cross-wise section extends from the elongate rod first end to a first end portion bend; and a first longitudinal section, wherein the first longitudinal section extends along the rear surface in a direction parallel to the top edge, and wherein the first longitudinal section extends from the first end portion bend to the first pass through portion first end;

a first pass through portion extending from the first pass through portion first end to a bag retaining section first end, wherein the first pass through portion passes through a first hole in the plate;

a bag retaining section having the bag retaining section first end coupled to the first pass through portion and a bag retaining section second end opposing the bag retaining section first end, and wherein the bag retaining section extends from the front surface of the plate;

a second pass through portion extending from the bag retaining section second end to a second pass through portion first end, wherein the second pass through portion passes through a second hole in the plate; and a second end portion extending from the second pass through portion first end to the elongate rod second end, wherein the second end portion is adjacent to the rear surface along a second end portion length.

2. The bag retaining fixture of claim 1, wherein the second end portion comprises:

a second longitudinal section, wherein the second longitudinal section extends along the rear surface in a direction parallel to the top edge, and wherein the second longitudinal section extends from the second pass through portion first end to a second end portion bend; and a second cross-wise section, wherein the second cross-wise section extends along the rear surface in a direction perpendicular to the top edge, and wherein the second cross-wise section extends from the second end portion bend to the elongate rod second end.

3. The bag retaining fixture of claim 2, wherein the first cross-wise section extends from the first end portion bend towards the bottom edge; and wherein the second cross-wise section extends from the second end portion bend towards the bottom edge.

4. The bag retaining fixture of claim 2, wherein the first cross-wise section extends from the first end portion bend towards the bottom edge; and wherein the second cross-wise section extends from the second end portion bend towards the top edge.

5. The bag retaining fixture of claim 4, wherein the bag retaining section comprises:

a first arm coupled to the first pass through portion, wherein the first arm extends from the bag retaining section first end to a first arm second end opposing a first arm first end;

a pressure section coupled to the first arm, wherein the pressure section extends from the first arm second end to a second arm second end; and a second arm coupled to the pressure section, wherein the second arm extends from the second arm second end to the bag retaining section second end.

6. The bag retaining fixture of claim 5, wherein:

the first arm comprises a first pressure elbow bend; and the second arm comprises a second pressure elbow bend.

7. The bag retaining fixture of claim 6, wherein the pressure section is straight.

8. The bag retaining fixture of claim 5, wherein the first and the second arm are straight.

9. The bag retaining fixture of claim 8, wherein the pressure section comprises a semi-circular section, wherein the semicircular section is in the shape of a semicircle, and wherein the semi-circular section comprises a first semicircular end coupled to the first arm, and a second semi-circular end coupled to the second arm.

10. A bagging station comprising:

a bagging station carousel having a side wall; and a bag retaining fixture coupled to the bagging station carousel, wherein the bag retaining fixture comprises:

a plate having a front surface, a rear surface, a top edge and a bottom edge, wherein the plate is coupled to the side wall; and an elongate rod coupled to the plate, wherein the elongate rod comprises:

an elongate rod first end and an elongate rod second end opposing the elongate rod first end;

a first end portion extending from the elongate rod first end to a first pass through portion first end, wherein the first end portion is adjacent to the rear surface along a first end portion length;

a first pass through portion extending from the first pass through portion first end to a bag retaining section first end, wherein the first pass through portion passes through a first hole in the plate;

a bag retaining section having a bag retaining section first end coupled to the first pass through portion and a bag retaining section second end, and wherein the bag retaining section extends from the front surface of the plate;

a second pass through portion extending from the bag retaining section second end to a second pass through portion first end, wherein the second pass through portion passes through a second hole in the plate; and a second end portion extending from the second pass through portion first end to the elongate rod second end, wherein the second end portion is adjacent to the rear surface along a second end portion length.

11. The bagging station of claim 10, wherein the first end portion comprises:

a first cross-wise section, wherein the first cross-wise section extends along the rear surface in a direction perpendicular to the top edge, and wherein the first cross-wise section extends from the elongate rod first end to a first end portion bend; and a first longitudinal section, wherein the first longitudinal section extends along the rear surface in a direction parallel to the top edge, and wherein the first longitudinal section extends from the first end portion bend to the first pass through portion first end.

12. The bagging station of claim 11, wherein the second end portion comprises:

a second longitudinal section, wherein the second longitudinal section extends along the rear surface in a direction parallel to the top edge, and wherein the second longitudinal section extends from the second pass through portion first end to a second end portion bend; and a second cross-wise section, wherein the second cross-wise section extends along the rear surface in a direction perpendicular to the top edge, and wherein the second cross-wise section extends from the second end portion bend to the elongate rod second end.

13. The bagging station of claim 10, wherein the bag retaining section comprises:

a first arm coupled to the first pass through portion, wherein the first arm extends from the bag retaining section first end to a first arm second end opposing first arm first end;

a pressure section coupled to the first arm, wherein the pressure section extends from the first arm second end to a second arm second end; and a second arm coupled to the pressure section, wherein the second arm extends from the second arm second end to the bag retaining section second end.

14. The bagging station of claim 13, wherein:

the first arm comprises a first pressure elbow bend; and the second arm comprises a second pressure elbow bend.

15. The bagging station of claim 14, wherein the pressure section comprises a straight length of rod.

16. The bagging station of claim 13, wherein the first and the second arm are straight.

17. The bagging station of claim 16, wherein the pressure section comprises a semi-circular section, and wherein the semi-circular section comprises a first semicircular end coupled to the first arm, a second semi-circular end coupled to the second arm, and a pressure point between the first semicircular end and the second semicircular end.

* * * * *